United States Patent [19]

Frohlicher

[11] 4,257,550

[45] Mar. 24, 1981

[54] PILFER-PROOF CONTAINER

[75] Inventor: Stephen G. Frohlicher, Hudson, Wis.

[73] Assignee: Liberty Carton Company, Minneapolis, Minn.

[21] Appl. No.: 69,342

[22] Filed: Aug. 24, 1979

[51] Int. Cl.[3] ..... B65D 5/30; B65D 45/00

[52] U.S. Cl. ..... 229/36; 229/33

[58] Field of Search ..... 229/33, 36, 34 R

[56] References Cited

U.S. PATENT DOCUMENTS

| | | | |
|---|---|---|---|
| 2,464,904 | 3/1949 | Tomarin | 229/36 |
| 3,023,945 | 3/1962 | Layne, Sr. | 229/36 |
| 3,112,058 | 11/1963 | Martin | 229/36 |
| 3,291,367 | 12/1966 | Carter | 229/34 X |
| 3,510,047 | 5/1970 | Pascus et al. | 229/36 |
| 3,543,995 | 12/1970 | Wilson | 229/36 |
| 3,826,420 | 7/1974 | Bamburg et al. | 229/36 X |
| 3,854,651 | 12/1974 | Osborne | 229/34 R |
| 3,889,868 | 6/1975 | Bruckner et al. | 229/34 R |
| 4,168,028 | 9/1979 | McCall | 229/34 R |

*Primary Examiner*—Davis T. Moorhead

*Attorney, Agent, or Firm*—Williamson, Bains, Moore & Hansen

[57] ABSTRACT

A container of pilfer-proof construction formed from a single blank of fiberboard cut, scored and folded together in such a way that the closure panels thereof are locked inside of the container at inaccessible locations. Lock flaps on the top closure panel are securely held in place by lock tabs thereon engaged between multiple wall segments of the container end walls.

7 Claims, 10 Drawing Figures

PILFER-PROOF CONTAINER

BACKGROUND OF THE INVENTION

Fiberboard containers formed from a single blank of fiberboard and having a cover panel foldable to a closed position over the top thereof are known. U.S. Pat. No. 3,889,868 discloses a container having such a top closure.

However, there are no known prior art containers of such a type which are closed in such a way as to prevent the closure panels from being easily opened to obtain access to the contents of the container. There is a need for such a container of tamper-proof construction for use in mailing and shipping valuable articles.

BRIEF SUMMARY OF THE INVENTION

This invention is directed to a container which may be quickly and easily folded to a fully closed condition from a single blank of fiberboard in such a way that its closure panels are locked internally of the container to prevent its being opened, the container having multiple wall segments when folded to its closed condition so as to provide maximum protection to its contents.

These basic objectives are realized by cutting and scoring the fiberboard blank to form a top closure panel foldable to a closed position over the container top defined by upright front, rear and end walls, with the top closure panel having lock flaps on its opposite ends inserted between multiple wall segments of the container end walls and securely held therein by lock tabs at an inaccessible location.

In a preferred embodiment of the invention, the lock tabs are hingedly connected to the aforesaid lock flaps and are folded over against the inside faces of the lock flaps as they are inserted between the end wall segments. After insertion, the lock tabs spring out into locking engagement with apertures formed in one of the wall segments of each end wall.

As an advantageous feature of the invention, the aforesaid closure panel retention apertures are formed in reinforcing flaps hingedly connected to opposite ends of the container front wall and folded into positions where they serve as reinforcing wall segments of the container end walls.

A strengthened, multiple thickness top wall is achieved by providing a top wall inner panel which is hingedly attached to the top longitudinal edge of the container front wall and is folded inwardly over the top of the container under the aforesaid top closure panel. Inaccessible detent means inside the container hold the top wall inner panel in its closed position. A rear wall reinforcing panel connected to the top wall inner panel is advantageously utilized in combination therewith by being folded down inside of the container in overlapping relation to the rear wall to provide a multiple thickness rear wall. The detent means for the top wall inner panel comprises locking heads on the opposite ends of the rear wall reinforcing panel restrainably engaged with complimentary notches formed on the innermost wall segment of each of the end walls.

These and other objects and advantages of my invention will be readily understood as the following description is read in conjunction with the accompanying drawings wherein like reference numerals have been utilized to designate like elements throughout the several views.

DESCRIPTION OF THE PREFERRED EMBODIMENT

Figure 1:
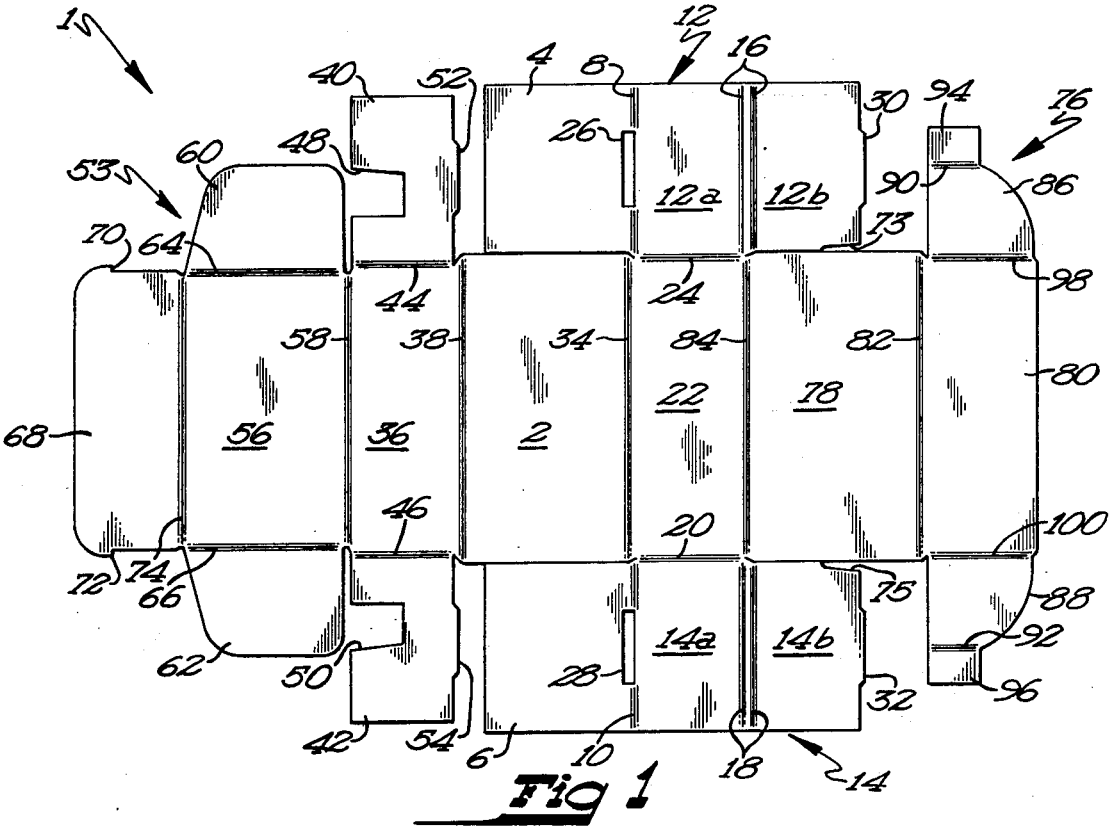
FIG. 1 is a plan view of the fiberboard blank from which the container of this invention is formed and assembled.

Referring now to the drawings, FIG. 1 shows a blank of fiberboard material generally indicated by reference numeral 1 which has been cut and scored in a particular manner in order to be foldable into the form of a pilfer and tamper-proof container. Fiberboard blank 1 is comprised of a plurality of panels connected along scored fold lines, one of which is a bottom wall 2. Bottom wall reinforcing panels 4 and 6 are hingedly attached along scored fold lines 8 and 10 to end wall sections generally indicated by numerals 12 and 14. Each of these end wall sections is comprised of a pair of end wall panels **12*a*, 12*b* and 14*a*, 14*b*, respectively. For a purpose hereinafter set forth, end wall panels 12*a* and 12*b* are connected along double score lines 16, and end wall panels 14*a* and 14*b* are connected along double score lines 18**.

End wall panel **12*a* is hingedly attached to one of the adjacent edges 24 of rear wall 22 along a fold line connection 24 therewith; and end wall panel 14*a* is attached in a similar manner to the opposite edge of rear wall 22 along fold line 20. Slots 26 and 28 are provided in bottom wall reinforcing panels 4 and 6 to receive lock tabs 30 and 32 on foldable end wall panels 12*b* and 14*b*** as hereinafter described.

Rear wall 22 is attached to bottom wall 2 along fold line 34, and a panel forming a front wall 36 is connected to the opposite, longitudinal edge of bottom wall 2 along fold line 38. On the opposite ends of front wall 36 are a pair of end wall reinforcing panels 40 and 42 hingedly connected thereto along fold lines 44 and 46. Slotted apertures 48 and 50 are provided as shown in panels 40 and 42 to serve as retention means for a top closure wall. Lock tabs 52 and 54 on end wall reinforcing panels 40 and 42 are also provided for locking engagement with apertures 26 and 28.

Reference numeral 53 generally indicates a top wall inner panel section 53 having a top wall inner panel 56 hingedly attached to front wall 36 along scored fold line 58 which becomes the top edge of front wall 36. Top wall inner panel section 53 is further comprised of wing flaps 60 and 62 hingedly connected along fold lines 64 and 66 to the opposite ends of top wall inner panel 56. At the outer end of top wall inner panel section 53 as viewed in FIG. 1 is a rear wall reinforcing panel 68 formed at its opposite ends to provide a pair of locking heads 70 and 72. Reinforcing panel 68 is attached to top wall inner panel 56 along fold line connection 74. Notches 73 and 75 are formed in end wall panels 12*b* and 14*b* as shown to receive and retain locking heads 70 and 72 on rear wall reinforcing panel 68 when it is folded to its closed position.

At the opposite end of cut and scored fiberboard blank 1 from top wall inner panel section 53 is a top wall outer closure panel section generally indicated by reference numeral 76. It is comprised of a top wall outer panel 78 and a front wall reinforcing panel 80 joined together along a scored fold line 82. Top wall outer panel 78 is the final closure panel for the container, and is attached to rear wall 22 along fold line connection 84. A pair of lock flaps 86 and 88 are provided on the opposite ends of front wall reinforcing panel 80 of the top wall closure panel section 76, these lock flaps being scored at their outer ends along score lines 90 and 92 to provide a pair of foldable lock tabs 94 and 96. Lock flaps 86 and 88 are hingedly connected to front wall reinforcing panel 80 along fold lines 98 and 100.

Figure 2:
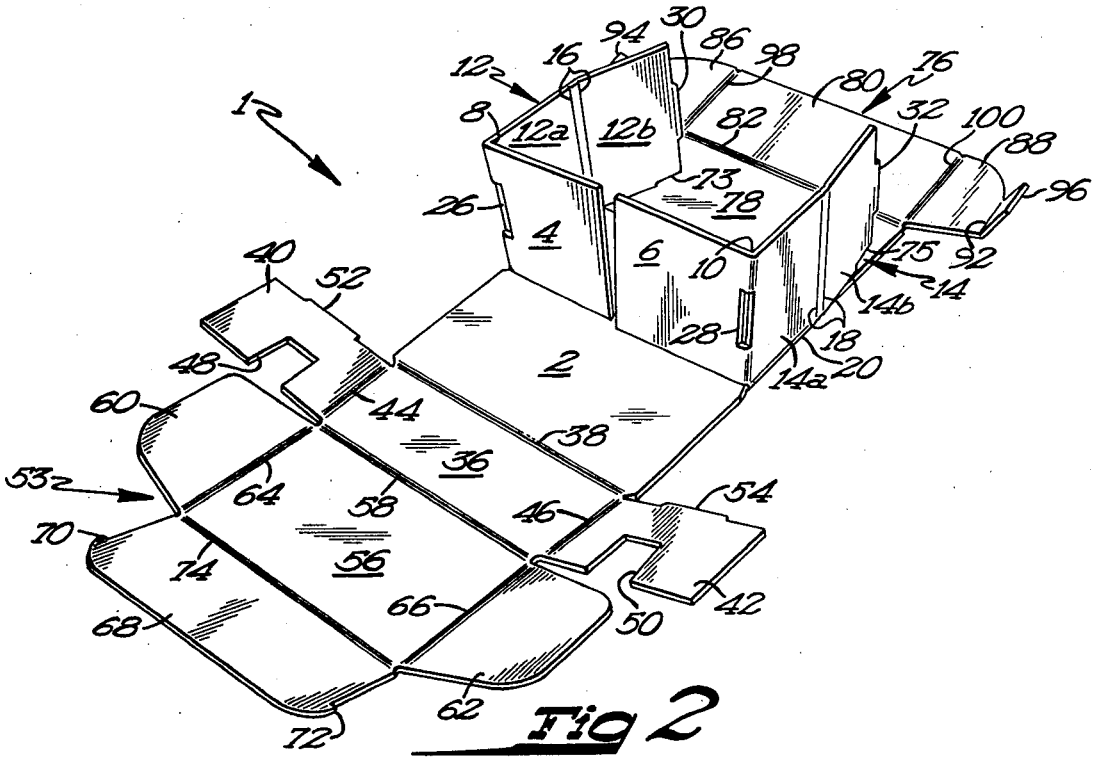
FIG. 2 is a perspective view showing the fiberboard blank at the initial stage of assembly wherein bottom wall reinforcing panels and end wall segments are folded to an intermediate position.
Figure 3:
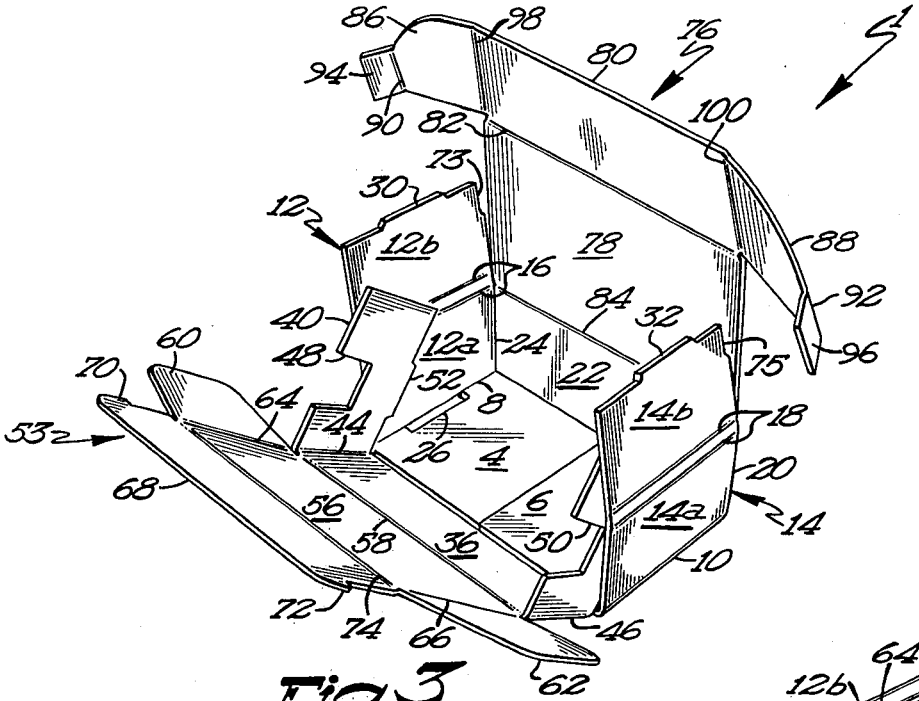
FIGS. 3, 4, 6, 7 and 8 show the container in successive stages of folding and assembly, with FIG. 8 showing the fully folded and closed container.
Figure 6:
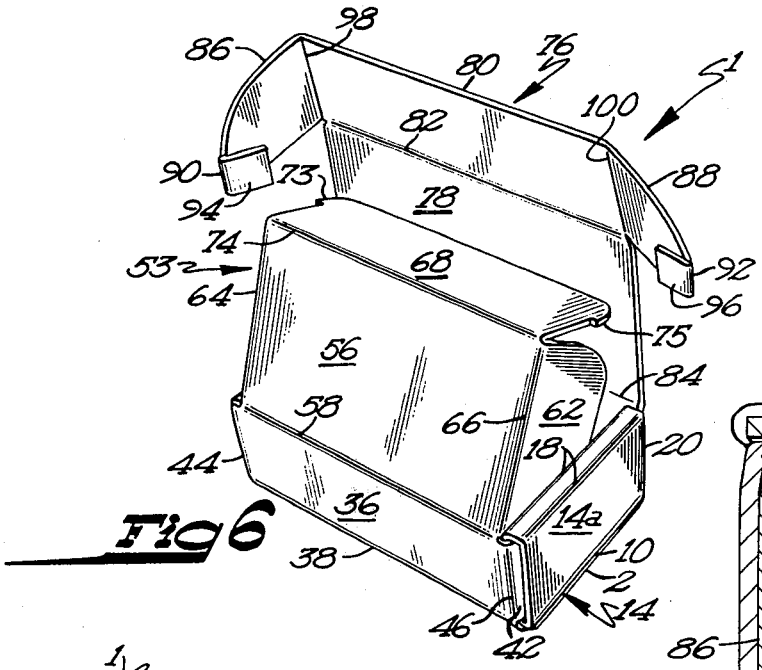
Figure 7:
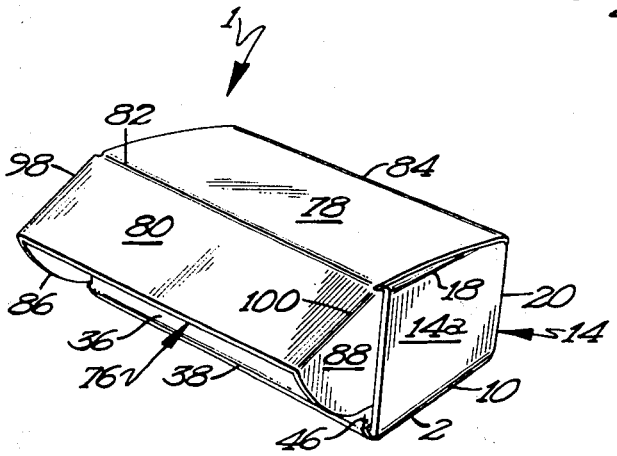
Figure 8:
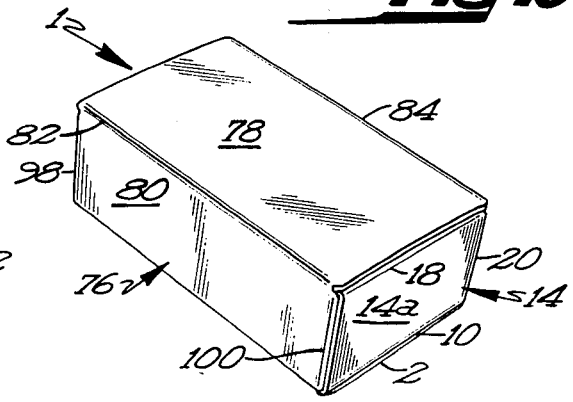

FIGS. 2 through 8 illustrate the series of sequential folding steps required to fold blank 1 to the condition of a fully closed container as illustrated in FIG. 8. FIG. 2 illustrates the first stage of folding assembly wherein end wall sections 12 and 14 have been folded upwardly along fold line connections 20 and 24 with rear wall 22 to bring end wall sections 12 and 14, along with bottom wall reinforcing panels 4 and 6 to an upright position, from which panels 4 and 6 have been folded inwardly to the position shown in FIG. 2. Next, rear wall 22 is folded upwardly and inwardly along its fold line connection 34 with bottom panel 2 to bring bottom wall reinforcing panels 4 and 6 in overlying, abutting engagement with bottom wall 2 for reinforcment thereof as illustrated in FIG. 3. With end wall 22 thus folded to the upright position of use shown in FIG. 3, end wall panels 12*a* and 14*a* are simultaneously brought to the upright, end wall positions shown in FIG. 3. Fold lines 20 and 24 connecting end wall panels 12*a* and 14*a* to rear wall 22 thus become the opposed, vertical edges thereof.

Figure 4:
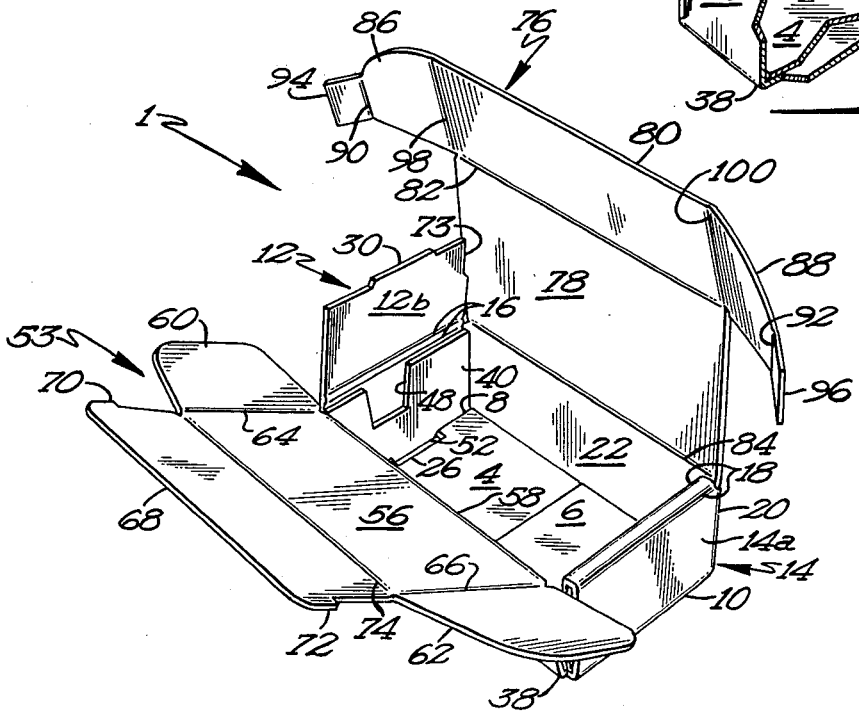

In the next stage of assembly illustrated in FIGS. 3 and 4, reinforcing flaps 40 and 42 are folded inwardly along their fold line connections 44 and 46 with front wall 36. As front wall 36 is then folded upwardly and inwardly towards rear wall 22 to its upright position of use, reinforcing panels 40 and 42 are positioned inside of end wall panels 12*a* and 12*b* in abutting, overlapping relation therewith. End wall panels 12*b* and 14*b* are then folded downwardly and inwardly over end wall reinforcing flaps 40 and 42 and locked in place by inserting their lock tabs 30 and 32 within slots 26 and 28, respectively, as illustrated in FIG. 4.

Figure 5:
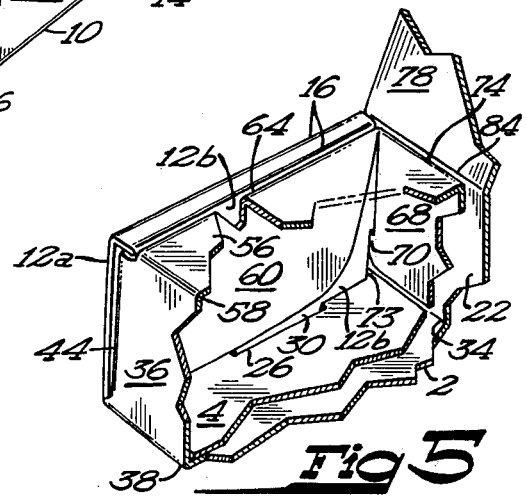
FIG. 5 is a fragmentary, perspective view with portions thereof broken away, and showing the folded container with only the outer, top closure panel remaining to be folded to its closed position.

The top of the container is then closed by first folding top wall inner panel section 53 inwardly along the fold line connection 58 of panel 56 with the top edge of front wall 36. Simultaneously with this procedure, wing flaps 60 and 62 are tucked inside of the end wall as illustrated in FIG. 6 to bring them into overlying, abutting engagement with end wall panels 12*b* and 14*b*. As this is done, rear wall reinforcing panel 68 is folded downwardly and inwardly inside of the container along its fold line 74 in overlying, reinforcing relation to rear wall 22. FIG. 5 illustrates this stage of the assembly of the container. Top wall inner panel section 53 is locked in place inside of the container by securely engaging locking heads 70 and 72 of rear wall reinforcing panel 68 with notches 73 and 75 on end wall panels 12*b* and 14*b*. FIG. 5 illustrates the locking engagement of locking head 70 with notch 73. It is also to be noted that lock tabs 52 and 54 on the bottom edges of end wall reinforcing flaps 40 and 42 are also received within slots 26 and 28 in bottom wall panels 4 and 6 as illustrated in FIGS. 4 and 5. This not only assists in securing reinforcing flaps 40 and 42 in place against the end walls, but also serves to help lock the entire top wall inner panel section 53 in its inwardly folded, closure position. Double score lines 16 and 18 on end wall sections 12 and 14 permit end wall panels 12*b* and 14*b* to be folded over the top of reinforcing flaps 40 and 42.

Figure 10:
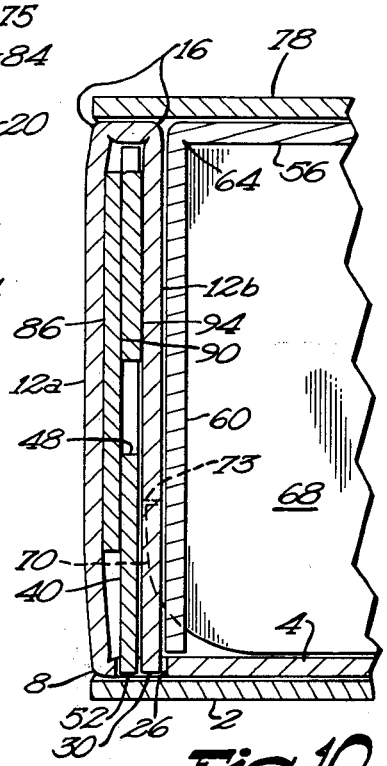
FIG. 10 is a section view of the fully folded and closed container taken along lines 10—10 of FIG. 9.
Figure 9:
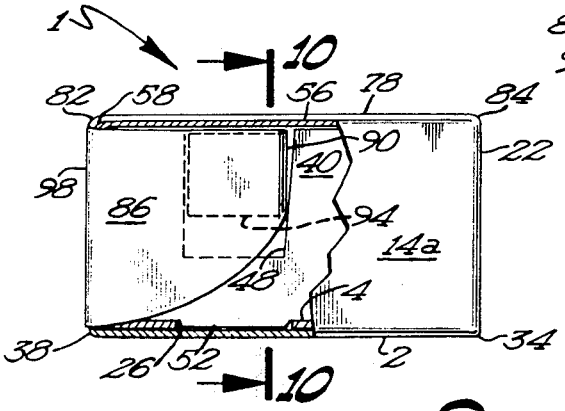
FIG. 9 is an end view of the container with portions thereof broken away.

In the final stages of folding assembly illustrated in FIGS. 7 and 8, top wall outer closure panel section 76 is folded downwardly and inwardly over the top of the container. As top wall outer panel 78 is folded inwardly along its fold line connection 84 with the top edge of rear wall 22, it is extended across the top of the container in overlying reinforcing relation to top wall inner panel 56. Simultaneously, front wall reinforcing panel 80 is folded downwardly and inwardly over the outer face of front wall 36 in overlying, reinforcing relation thereto. As this is done, lock flaps 86 and 88 are folded downwardly and inwardly along their fold line connections 98 and 100 with front wall reinforcing panel 80. At this time, lock tabs 94 and 96 are folded over against the inside faces of lock flaps 86 and 88, with the lock flaps then being inserted between the multiple wall segments of the end walls. As front wall reinforcing panel 80 is then folded downwardly into abutting engagement with front wall 36, lock flaps 86 and 88 are thereby forced towards the rear of the container to a position wherein lock tabs 94 and 96 are brought into alignment with apertures 48 and 50. When this happens, lock tabs 94 and 96 spring out into locking engagement with apertures 48 and 50 of reinforcing flaps 40 and 42, as illustrated in FIGS. 9 and 10.

The container is thus securely held in the fully closed condition shown in FIG. 8. With lock tabs 94 and 96 engaged within apertures 48 and 50 at an inaccessible location within the multiple wall segments of the container end walls, there is no way that the top wall closure panel section 76 can be disengaged and opened. Moreover, the container is further secured by the detent means comprised of notches 73, 75 and locking heads 70, 72 positively holding top wall inner panel section 53 in place at an inaccessible location inside of the closed container.

As may readily be understood from the foregoing description, every wall of the closed container is formed of multiple thicknesses of fiberboard wall panels or segments, thereby providing further security and protection against damage. Inner and outer top wall panels 56 and 78 provide a double wall thickness for the top of the container. The end walls are comprised of multiple wall segments in overlapping, abutting engagement with each other as illustrated in FIG. 10. Thus, one of the end walls is comprised of panels 12*a*, 12*b*, apertured reinforcing flap 40, and wing flap 60. The rear wall of the container has a double wall thickness comprised of rear wall 22 and reinforcing panel 68; and the front wall of the container is comprised of multiple thicknesses consisting of front wall 36 and reinforcing panel 80. The bottom wall 2 is reinforced by bottom wall panels 4 and 6 folded down on top thereof.

Those skilled in the art will appreciate that the fiberboard container described herein may be simply and easily folded to a fully closed condition wherein inaccessible locking means are engaged to prevent the closure panels from being opened. It is anticipated that various changes may be made in the size, shape and construction of the container disclosed herein without departing from the spirit and scope of the invention as defined by the following claims.

What is claimed is:

1. A pilfer proof container formed from a single blank of cut and scored fiberboard comprising:

a bottom wall;

a pair of front and rear walls hingedly attached to said bottom wall along fold line connections with the opposite, longitudinal edges thereof;

a pair of opposed end walls cooperating with said front and rear walls to form a substantially rectangular container;

a top wall inner panel hingedly attached to the top, longitudinal edge of said front wall and folded inwardly over the top of said container;

a rear wall reinforcing panel hingedly connected to the inner, longitudinal edge of said top wall inner panel and folded down inside of said container in overlapping relation to said rear wall to form a double wall thickness therewith;

detent means restrainably securing said top wall inner panel inside of said container at an inaccessible location therein;

a top wall outer closure panel hingedly connected along a fold line to the top edge of said rear wall and folded to a closed position overlying said top wall inner panel;

locking means on opposite ends of said top wall outer closure panel; and complimentary retention means on each of said end walls within which said locking means of said top wall outer closure panel are held in locking engagement at an inaccessible location inside of said container.

2. A container as defined in claim 1 wherein:

each of said end walls is comprised of a plurality of fiberboard wall segments disposed in overlying relation to each other to form multiple thickness end walls;

an aperture in one of said wall segments of each of said end walls; and said locking means comprises a pair of lock tabs on opposite ends of said top wall outer closure panel received between said plurality of wall segments of each of said end walls in restraining engagement with said apertures.

3. A container as defined in claim 2 wherein:

a pair of lock flaps are hingedly connected to the opposite ends of said top wall outer closure panel and inserted between said wall segments of each of said end walls, and said pair of lock tabs are hingedly connected to said lock flaps along fold line connections therewith and folded over against the inside faces of each of said lock flaps as said flaps are inserted between said end wall segments, whereby said lock tabs spring out from said lock tabs into said apertures in restraining engagement therewith when brought into alignment with said apertures.

4. A container as defined in claim 1 wherein:

each of said end walls is comprised of a plurality of fiberboard wall segments disposed in overlying relation to each other to form multiple thickness end walls; and said detent means comprises locking head members formed on the opposite ends of said rear wall reinforcing panel and complimentary notch means formed on the innermost wall segment of each of said end walls within which said locking members are restrainably received.

5. A pilfer proof container formed a single blank of cut and scored fiberboard comprising:

a bottom wall;

a pair of front and rear walls hingedly attached to said bottom wall along fold line connections with the opposite longitudinal edges thereof;

a pair of opposed end walls cooperating with said front and rear walls to form a substantially rectangular container, each of said end walls being comprised of a plurality of fiberboard wall segments disposed in overlying relation to each other to form multiple thickness end walls;

an aperture in one of said wall segments of each end wall;

a top closure wall section hingedly connected along a fold line to the top edge of said rear wall and foldable to a closed position extending over the top of said container; and locking means integrally formed on the opposite ends of said top closure wall section and received between said plurality of wall segments of said end walls in restraining engagement with said apertures at an inaccessible location inside of said container, when said top closure wall section is folded to said closed position;

a top wall inner panel section hingedly attached to the top longitudinal edge of said front wall and folded inwardly over the top of said container under said top closure wall section in a closed position; and inaccessible detent means inside of said container holding said top wall inner panel section in said closed position, said detent means comprising locking members formed on opposite ends of said top wall inner panel section and complementary notch means formed on the inner most wall segment of each of said end panels.

6. A container as defined in claim 5 wherein:

said top wall inner panel section comprises a top wall inner panel extending over the top of said container under said top closure wall section and a rear wall reinforcing panel connected thereto along a fold line and folded downwardly inside of said rear wall in overlying relation thereto.

7. A container as defined in claim 6 wherein: said locking members of said detent means are formed on the opposite ends of said rear wall reinforcing panel.

* * * * *